United States Patent [19]

Kimura et al.

[11] Patent Number: 4,593,532

[45] Date of Patent: Jun. 10, 1986

[54] EVAPORATION-COOLED GAS INSULATED ELECTRICAL APPARATUS

[75] Inventors: Minoru Kimura, Takarazuka; Michitada Endo, Suita, both of Japan

[73] Assignee: Mitsubishi Denki Kabushiki Kaisha, Japan

[21] Appl. No.: 669,327

[22] Filed: Nov. 8, 1984

[30] Foreign Application Priority Data

Nov. 10, 1983 [JP] Japan ..... 58-209806

[51] Int. Cl.[4] ..... F25D 19/00

[52] U.S. Cl. ..... 62/119; 62/78; 165/104.21; 220/88 B

[58] Field of Search ..... 62/78, 119; 165/104.21; 220/88 B

[56] References Cited

U.S. PATENT DOCUMENTS

| | | | |
|---|---|---|---|
| 2,499,736 | 3/1950 | Afkleen | 62/119 |
| 2,875,263 | 2/1959 | Narbut | 62/119 |
| 3,561,229 | 2/1971 | Levin | 62/119 |
| 4,188,793 | 2/1980 | Watson | 62/119 |

FOREIGN PATENT DOCUMENTS 54-26688 9/1979 Japan .

*Primary Examiner*—Ronald C. Capossela

*Attorney, Agent, or Firm*—Leydig, Voit and Mayer, Ltd.

[57] ABSTRACT

An evaporation-cooled gas insulated electrical apparatus comprising, in a housing, an electrical device generating heat when in operation, a condensable refrigerant convertible between liquid and vapor phases, and a noncondensable, electrically insulating gas. The condensable refrigerant and the noncondensable gas are selected so that the ratio $V_g/V_l$ of the gas phase volume $V_g$ and the liquid phase volume $V_l$ is between 1 and 10, and so that the specific weight of the noncondensable gas is smaller than the specific weight of the vapor of the condensable refrigerant during operation, and so that the noncondensable gas and the condensable refrigerant vapor are separated due to the difference in their specific weights. The noncondensable gas is a mixture of two noncondensable gases, one of the mixed gases having a very small solubility into the condensable refrigerant compared to that of the other mixed gas, and the condensable refrigerant is a fluorocarbon liquid having a boiling point between 80° C. and 160° C. and a mean molecular weight of between 180 and 700.

5 Claims, 7 Drawing Figures

EVAPORATION-COOLED GAS INSULATED ELECTRICAL APPARATUS

BACKGROUND OF THE INVENTION

This invention relates to an evaporation-cooled gas insulated electrical apparatus, and more particularly to an evaporation-cooled gas insulated electrical apparatus in which the cooling is achieved by a change of phase of a condensable refrigerant and in which an electrically insulating gas fills in the space around the electrical device.

One example of an evaporation-cooled gas insulated electrical apparatus of a conventional design is illustrated in FIG. 1. The electrical apparatus comprises a hermetic housing 10 in which an electric device 12 such as a transformer which generates heat during operation is disposed. The interior of the housing 10 is filled with an electrically insulating noncondensable gas 14 such as $SF_6$ gas for electrically insulating the electrical device 12 from the housing wall. An electrically insulating cooling fluid that is a condensable refrigerant 16, such as Florinate FC-75 (trade name), is also disposed in the housing 10. The condensable refrigerant 16 is evaporatable into a refrigerant vapor 18 at the operating temperature of the electrical device 12 to be cooled. The housing 10 comprises a cooler 20 for cooling the refrigerant vapor 18 within the housing 10. The electrical apparatus also comprises a refrigerant liquid circulating system 22 including a pump 24, pipes 26 connecting the refrigerant sump 28 at the bottom of the cooler 20 to the pump 24, a pipe 30 connecting a refrigerant sump 32 at the bottom of the housing 10 to the circulating pump 24, and a conduit 34 extending vertically upwards from the pump 24 to the top of the electrical device 12 and having at the upper end a spraying head 36 positioned above the top portion of the electrical device 12.

In a typical evaporation-cooled gas insulated electrical apparatus, the internal pressure within the housing 10 is set higher than atmospheric pressure even at a low temperature of −20° C., and the operating temperature of the electrical device 12 disposed within the housing 10 is as high as about 130° C. Also, the condensable refrigerant 16 and the non-condensable gas 14 are selected so that the ratio $V_g/V_l$ of the gas phase volume $V_g$ and the liquid phase volume $V_l$ of the condensable refrigerant 16 is set to be between 1 and 10.

In operation, as the electric device such as a transformer 12 is operated to generate heat, the liquid phase condensable refrigerant 16 is sprayed over the transformer 12 by means of the refrigerant circulating system 22 as illustrated by arrows 40. Some part of the sprayed liquid refrigerant 16 is evaporated by contact with the hot transformer surface to form the condensable refrigerant vapor 18 which cools the transformer 12 by its latent heat, as shown by arrows 42. The refrigerant that has not been evaporated flows down as shown by arrows 44 on the surfaces of the transformer 12 and is collected in the sump 32 at the bottom of the housing 10. Since the specific weight of the condensable refrigerant vapor 18 is greater than the specific weight of the noncondensable gas 14, the condensable refrigerant vapor 18 stays under the noncondensable gas 14 providing a definite interface therebetween.

The condensable refrigerant vapor 18 thus generated is cooled and condensed into liquid refrigerant 16 by the condenser 20 and the condensed refrigerant 16 is returned to the sump 32 through the pipe 26. Since the volume of the refrigerant vapor 18 decreases when the vapor converts into the liquid refrigerant 16, the pressure within the condenser 20 becomes lower than that in the housing 10 as the vapor 18 in the condenser 20 condenses into the liquid 16, thereby causing a flow of the condensable refrigerant vapor 18 as shown by an arrow 46. The condensed refrigerant 16 collected in the sump 32 is circulated by the refrigerant circulating system 22 through the pipe 30, the pump 24, the pipe 34 and the refrigerant spraying head 36 disposed above the transformer 12.

While the condensable refrigerant 16 circulates in the housing 10 and in the condenser 20 in the manner above described, the noncondensable gas 14 contained in the housing 10 stays in the upper portion of the interior of the housing 10 and the condenser 20 and contacts the refrigerant vapor 18.

In order that the above-described evaporation cooling functions properly, the level of the condensable refrigerant vapor 18 must reach a predetermined level within the condenser 20, and when this condition is satisfied, the pressure within the housing 10 is as illustrated in FIG. 2. That is, in FIG. 2, P18' represents the partial pressure of the condensable refrigerant vapor 18 in the upper section A in which the noncondensable gas 14 stays, and P14' represents the partial pressure of the noncondensable gas 14 in the lower section B in which the condensable refrigerant vapor 18 stays. When the condensable refrigerant 16 and the noncondensable gas 14 are selected as previously described, the partial pressure P14' and P18' can be considered to be zero $kg/cm^2$.

Also, P14 is the pressure of the noncondensable gas 14 is the upper section A, and P18 is the pressure of the condensable refrigerant vapor 18 in the lower section B of the housing 10. When the noncondensable gas 14 and the condensable refrigerant vapor 18 are completely separated, the pressure P14 of the noncondensable gas 14 in the upper section A, the pressure P18 of the condensable refrigerant vapor 18 in the lower section B, and the total pressure Pt which is the sum of the pressures P14 and P18 are nearly equal to each other because the partial pressures P14' and P18' are nearly zero. This condition occurs at a temperature higher than the temperature T1 at which the noncondensable gas pressure P14 and the condensable refrigerant vapor pressure P18 are equal to each other as shown in FIG. 3, in which one example of the relationship between the pressures within the housing and the gas temperature is plotted. In this example, the noncondensable gas 14 is $SF_6$ gas and the condensable refrigerant 16 is a fluorocarbon, such as Florinate FC-75 (trade name).

The pressure P14 of the noncondensable gas 14 at the temperature $T_1$ shown in FIG. 3 is composed of two components, $P14_1$ and $P14_0$, as shown in FIG. 4. That is, the pressure P14 at the temperature $T_1$ is a sum of the pressure $P14_1$ that linearly increases as the temperature increases according to Boyle' Law, and the pressure $P14_0$ that increases because the noncondensable gas 14 is released from the condensable refrigerant 16 due to the temperature increase.

The reason that the above pressure $P14_0$ is generated will now be described in conjunction with FIG. 7 in which the solubilities of $SF_6$ gas and nitrogen gas into the fluorocarbon, in this case Florinate FC-75 (trade name), as plotted against temperature are shown. As seen from the graph of FIG. 7, the solubility of $SF_6$ gas when the temperature of the fluorocarbon liquid is −20° C. is more than ten times as high as the solubility of $SF_6$ gas when the fluorocarbon liquid is at 130° C. Therefore, almost all the $SF_6$ gas dissolved in the fluorocarbon liquid at −20° C. is released in the gas phase. Since the solubility of the $SF_6$ gas in the fluorocarbon liquid is proportional to the partial pressure of the $SF_6$ gas above the level of the condensable refrigerant 16 (Henry's law), when the liquid temperature is elevated to about 130° C. as previously discussed, the pressure above the liquid level is increased and the solubility tends to increase compared to that at atmospheric pressure. However, in order that all the $SF_6$ gas dissolved in the refrigerant 16 at −20° C. remains within the refrigerant liquid 16 even when the temperature increases to about 130° C., the pressure within the housing 10 must be more than ten times that of the conventional design.

Therefore, when the pressure within the housing 10 is set at atmospheric pressure at −20° C., a pressure equivalent to several times atmospheric pressure is generated within the housing 10 at 130° C. due to the $SF_6$ gas released from the liquid refrigerant when the ratio $V_g/V_1$ of the gas phase volume $V_g$ and the liquid phase volume $V_1$ of the condensable refrigerant 16 is selected to be between 1 and 10 as previously described. This requires that the vessel or housing 10 of the evaporation-cooled gas insulated electrical apparatus be mechanically strong, causing the overall structure of the apparatus to be heavy, bulky, and expensive. Alternatively, if the temperature increase is to be limited to a lower level, the capacity of the condenser 20 must be increased, which also causes increases in the weight, dimensions, and cost of an evaporation-cooled gas insulated electrical apparatus.

SUMMARY OF THE INVENTION

Accordingly, an object of the present invention is to provide an evaporation-cooled gas insulated electrical apparatus in which the disadvantages of the conventional evaporation-cooled gas insulated electrical apparatus as above described are eliminated.

Another object of the present invention is to provide an evaporation-cooled gas insulated electrical apparatus which is compact, lightweight, and inexpensive.

Still another object of the present invention is to provide an evaporation-cooled gas insulated electrical apparatus in which the increase in the internal pressure in the housing is limited to a relatively low level even at an elevated temperature.

Still another object of the present invention is to provide an evaporation-cooled gas insulated electrical apparatus in which the increase of the internal pressure is limited to be not higher than the pressure increase due to the thermal expansion even when the temperature of the noncondensable gas is increased.

With the above objects in view, the evaporation-cooled gas insulated electrical apparatus of the present invention comprises, in a housing, an electrical device generating heat when in operation, a condensable refrigerant convertible between two phases, and a noncondensable, electrically insulating gas. The condensable refrigerant and the noncondensable gas are selected so that the ratio $V_g/V_1$ of the gas phase volume $V_g$ and the liquid phase volume $V_1$ is between 1 and 10, and so that the specific weight of the noncondensable gas is smaller than the specific weight of the vapor of the condensable refrigerant during operation, and so that the noncondensable gas and the condensable refrigerant vapor are separated due to the difference in their specific weights. The noncondensable gas is a mixture of two noncondensable gases, one of the mixed gases having a very small solubility in the condensable refrigerant as compared to that of the other mixed gas, and the condensable refrigerant is a fluorocarbon liquid having a boiling point between 80° C. and 160° C. and a mean molecular weight of between 180 and 700.

BRIEF DESCRIPTION OF THE DRAWINGS

The present invention will become more readily apparent from the following detailed description of the preferred embodiment taken in conjunction with the accompanying drawings, in which.

DETAILED DESCRIPTION OF THE PREFERRED EMBODIMENT

Figure 1:
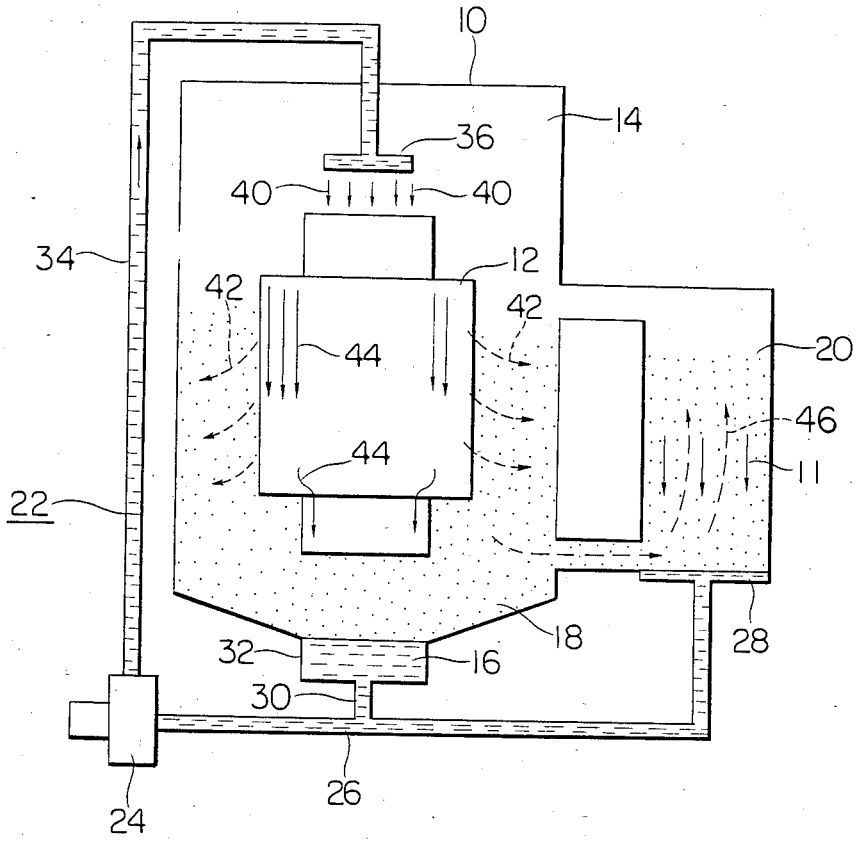
FIG. 1 is a schematic diagram of an evaporation-cooled gas insulated electrical apparatus to which the present invention is applicable.
Figure 2:
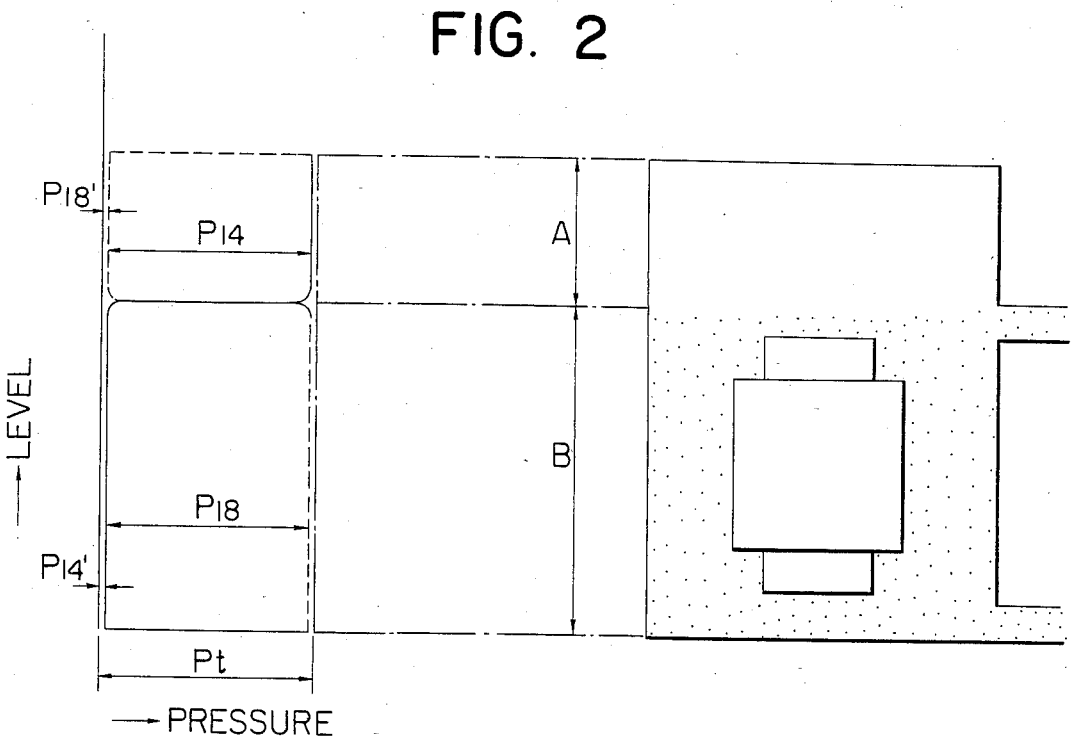
FIG. 2 is a diagram for explaining the distribution of the noncondensable gas and the condensable refrigerant vapor in connection with the level of the vapor within the housing shown in FIG. 1.
Figure 3:
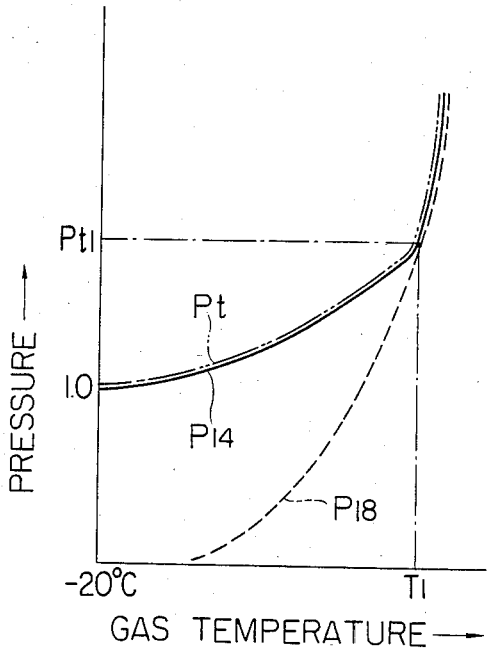
FIG. 3 is a graph showing the pressure within the housing plotted against the gas temperature in the conventional evaporation-cooled gas insulated electrical apparatus.
Figure 4:
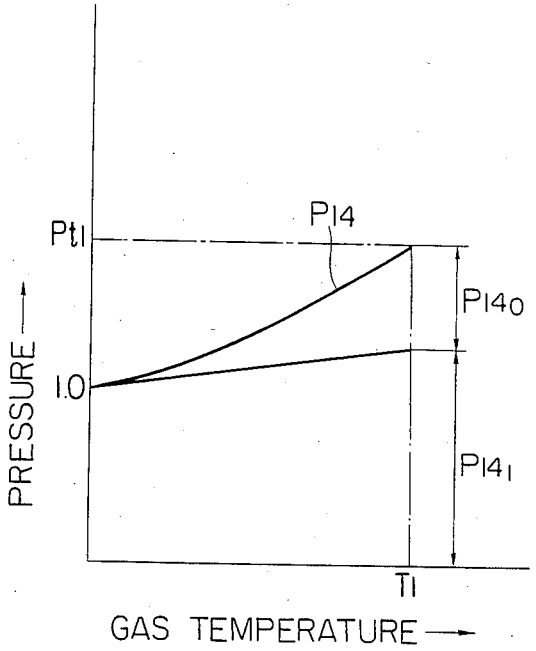
FIG. 4 is a graph showing the pressure plotted against the gas temperature for explaining the manner in which the pressure P14 increases in the conventional design shown in FIG. 3.
Figure 5:
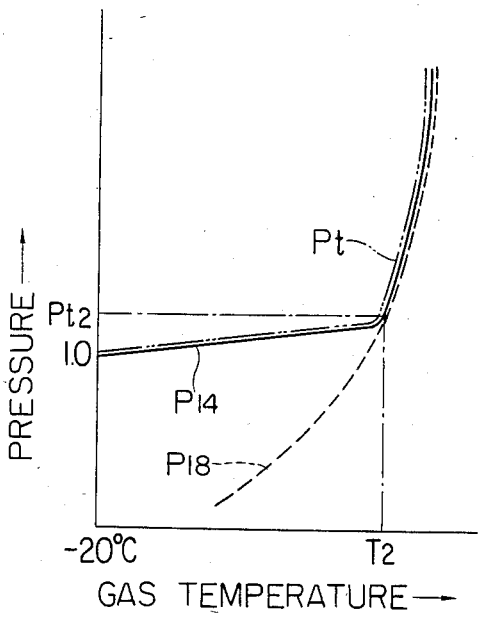
FIG. 5 is a graph showing the pressure within the housing plotted against the gas temperature in the evaporation-cooled gas insulated electrical apparatus of the present invention.
Figure 6:
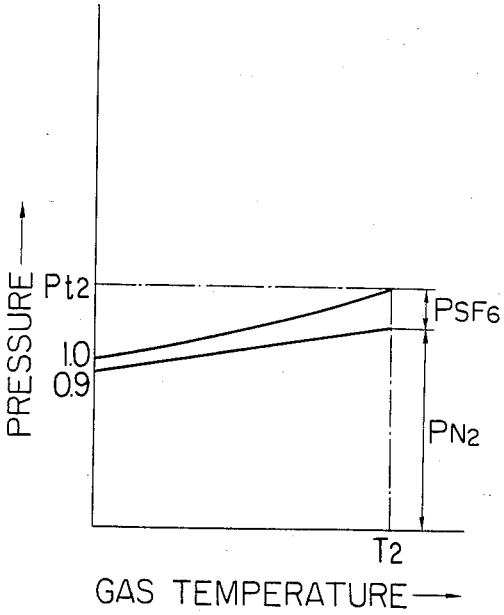
FIG. 6 is a graph showing the pressure plotted against the gas temperature for explaining the manner in which the pressure P14 increases in the apparatus of the present invention.
Figure 7:
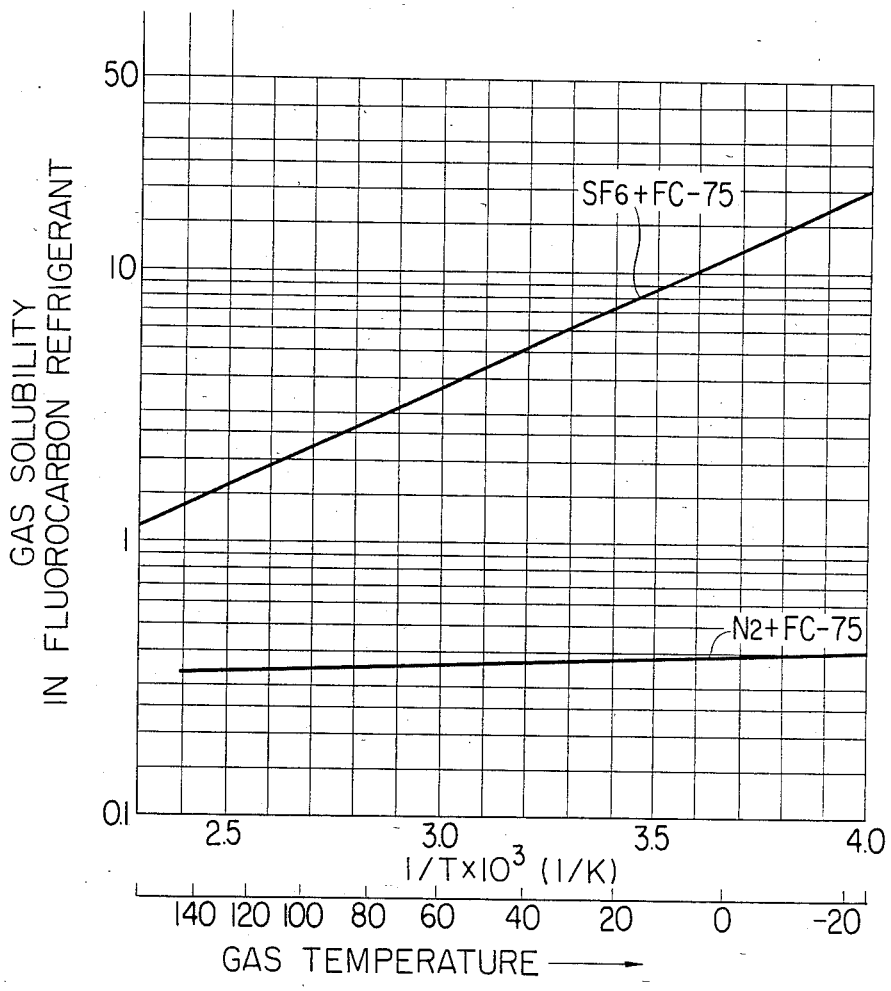
FIG. 7 is a graph showing the solubilities of $SF_6$ gas and $N_2$ gas with respect to Florinate FC-75.

The evaporation-cooled gas insulated electrical apparatus of the present invention is, according to the preferred embodiment thereof, of a structure similar to the evaporation-cooled gas insulated electrical apparatus previously described in conjunction with FIGS. 1 to 4, and comprises an housing 10, an electrical device 12 generating heat when in operation, a condensable refrigerant 50 convertible between liquid and vapor phases, and a noncondensable, electrically insulating gas 52. The evaporation-cooled gas insulated electrical apparatus of the present invention is different from the apparatus of the conventional design in that the noncondensable gas 52 consisting of 10% by volume of $SF_6$ gas and 90% by volume of $N_2$ gas is used in place of 100% $SF_6$ gas. The condensable refrigerant 50 is Florinate FC-75 which is a trade name of a fluorocarbon. The relationship of the pressures of gases in the housing with respect to the gas temperature according to the present invention is shown in FIG. 5, which is similar to the graph for the conventional design shown in FIG. 3. As seen from the graph of FIG. 6, which corresponds to the graph shown in FIG. 4, the rate of change of solubility of $N_2$ in Florinate FC-75 with respect to temperature is small and the amount of dissolved $N_2$ is also very small as compared to $SF_6$ gas. Further, since the partial pressure of the $SF_6$ gas above the refrigerant level is only one tenth of the value in the conventional design, the amount of $SF_6$ gas dissolved in the condensable refrigerant is only one tenth of that in the conventional design at a low temperature. Therefore, cooling is properly achieved as illustrated in FIG. 6. The rated operating pressure $Pt_2$ in the housing and the rated operating temperature $T_2$ when the noncondensable gas is a mixture of $SF_6$ and $N_2$ are lower than the rated operating pressure $Pt_2$ and the rated operating temperature $T_2$ of the conventional apparatus shown in FIGS. 3 and 4.

Although the present invention has been described in conjunction with a particular preferred embodiment, various modifications and alternations may be made. For example, similar advantageous effects can be obtained by a noncondensable gas which is a mixture consisting of 5–20% by volume of $SF_6$ gas and 95–80% by volume of $N_2$ gas. Furthermore, similar advantageous effects can also be obtained by utilizing a mixture of 10–40% by volume of hexafluoroethane ($C_2F_6$) gas in place of the $SF_6$ gas and 90–60% by volume of $N_2$ gas as the noncondensable gas.

As has been described, according to the present invention, the noncondensable gas is a mixture of two noncondensable gases, and one of the mixed gases has a very small solubility in the condensable refrigerant as compared to that of the other mixed gas, and the condensable refrigerant is a fluorocarbon liquid having a boiling point between 80° C. and 160° C. and a mean molecular weight of between 180 and 700. Therefore, the operating temperature as well as the operating pressure can be made low as compared to those in the conventional design, providing an evaporation-cooled gas insulated electrical apparatus that is light-weight, compact, less expensive, and reliable.

What is claimed is:

1. An evaporation-cooled gas insulated electrical apparatus comprising in a housing:

an electrical device generating heat when in operation;

a condensable refrigerant convertible between liquid and vapor phases; and a noncondensable, electrically insulating gas;

said condensable refrigerant and said noncondensable gas being selected so that the ratio $V_g/V_1$ of the gas phase volume $V_g$ and the liquid phase volume $V_1$ is between 1 and 10, and so that the specific weight of the noncondensable gas is smaller than the specific weight of the vapor of the condensable refrigerant during operation, and so that said noncondensable gas and said condensable refrigerant vapor are separated due to the difference in their specific weights;

said noncondensable gas being a mixture of two noncondensable gases, one of the mixed gases having a very small solubility into the condensable refrigerant as compared to that of the other mixed gas; and said condensable refrigerant being a fluorocarbon liquid having a boiling point between 80° C. and 160° C. and a mean molecular weight of between 180 and 700.

2. An evaporation-cooled gas insulated electrical apparatus as claimed in claim 1, wherein one of the gases mixed to form said noncondensable gas is $SF_6$ gas, and said noncondensable gas consists of 5 to 20% by volume of $SF_6$ gas and 95 to 80% by volume of the other noncondensable gas.

3. An evaporation-cooled gas insulated electrical apparatus as claimed in claim 2, wherein said other noncondensable gas to be mixed with the $SF_6$ gas is $N_2$ gas.

4. An evaporation-cooled gas insulated electrical apparatus as claimed in claim 1, wherein said one of the noncondensable gas to be mixed to form said noncondensable gas is hexafluoroethane ($C_2F_6$) gas, and said noncondensable gas consists of 10 to 40% by volume of $C_2F_6$ gas and 90 to 60% by volume of said other noncondensable gas.

5. An evaporation-cooled gas insulated electrical apparatus as claimed in claim 4, wherein said other noncondensable gas to be mixed with $C_2F_6$ gas is $N_2$ gas.

* * * * *